US005251340A

United States Patent [19]

Su-Land

[11] Patent Number: 5,251,340

[45] Date of Patent: Oct. 12, 1993

[54] FLUSH TOILET WITH AN AUTOMATIC STERILIZING DEVICE

[76] Inventor: Liao Su-Land, Room 2, 5th Fl., No. 13, Lane 198, Chung-Hsing Rd., Fung-Yuan City, Tai-Chung Hsian, Taipei, Taiwan

[21] Appl. No.: 848,288

[22] Filed: Mar. 9, 1992

[51] Int. Cl.[5] ..... E03D 9/02

[52] U.S. Cl. ..... 4/304; 4/309; 4/226.1

[58] Field of Search ..... 4/302, 304, 305, 309, 4/313, 222, 226.1, 224

[56] References Cited

U.S. PATENT DOCUMENTS

| | | | |
|---|---|---|---|
| 1,240,831 | 9/1917 | Doering, Jr. | 4/309 X |
| 3,001,210 | 9/1961 | Diehl | 4/309 X |
| 3,314,081 | 4/1967 | Atkins et al. | 4/304 |
| 3,358,299 | 12/1967 | Maude | 4/226.1 |
| 3,445,865 | 5/1969 | Rumsey, Jr. | 4/309 |
| 3,593,073 | 7/1971 | Atkins | 4/304 X |
| 3,639,920 | 2/1972 | Griffin et al. | 4/304 X |
| 3,648,298 | 3/1972 | Gross | 4/309 X |
| 4,805,247 | 2/1989 | Laverty, Jr. | 4/304 |
| 5,031,258 | 7/1991 | Shaw | 4/304 X |
| 5,062,453 | 11/1991 | Saadi et al. | 4/304 x |

FOREIGN PATENT DOCUMENTS

| | | | |
|---|---|---|---|
| 4338825 | 10/1989 | European Pat. Off. | 4/226.1 |
| 3003591 | 8/1981 | Fed. Rep. of Germany | 4/224 |
| 3615655 | 11/1987 | Fed. Rep. of Germany | 4/226.1 |
| 0247620 | 10/1989 | Japan | 4/302 |
| 0194219 | 7/1990 | Japan | 4/224 |
| 4007426 | 1/1992 | Japan | 4/304 |
| 0673129 | 2/1990 | Switzerland | 4/313 |

*Primary Examiner*—William A. Cuchlinski, Jr.
*Assistant Examiner*—John L. Beres
*Attorney, Agent, or Firm*—Young and Forward
International Patent and Tradmark Office

[57] ABSTRACT

This invention provides a flush toilet with an automatic sterilizing device, which can discharge a small volume of flush water first upon sensing a user having used it, and then discharge a large volume with a given volume of sterilizing liquid so as to wash away any urine sediment in a urinal completely. The device comprises a control circuit to control a solenoid valve for controlling a given volume of flush water, and to control a sterilizing unit; the sterilizing unit includes a sterilizing liquid container which is controlled with a liquid pump to discharge liquid. The liquid pump is controlled with the control circuit. During the large volume discharge of water the liquid pump can pump and discharge a suitable volume of sterilizing liquid to mix with the flush water to wash and sterilize a urinal simultaneously.

1 Claim, 6 Drawing Sheets

FLUSH TOILET WITH AN AUTOMATIC STERILIZING DEVICE

BACKGROUND OF THE INVENTION

The flush toilet or urinal has been an important item of equipment in our daily living; for instance, each current urinal is commonly provided with an automatic flush device, which can sense when the urinal is being used by a person. If it senses a user using the same, the urinal will first discharge a small volume of water, and as soon as the user leaves it, a large volume of water will be discharged therefrom to clean any urine that might be left. However, while the conventional flush toilet or urinal can flush away the urine, it is unable to clean and remove the urine sediment or residue accumulated in the urinal; as a result, the urinal emits an undesired odor. Deodorant devices have been installed over or in the urinal for masking undesired odors. Although such urinal equipment can mask an undesired odor and provide a user with a fragrant atmosphere upon the urine being flushed, the urinal would still have an undesired urine sediment accumulation after a period time. Also, an undesired odor can still be generated to mix with the deodorant so as to produce a strange odor. In order to solve the aforesaid problem, it is necessary to have a person clean the urinal daily. Unfortunately, such a practice of cleaning a urinal can not be afforded by the average public, except by a corporation or the like. For a public flush toilet, such a practice would be expensive and therefore most often the public toilets and urinals are not cleaned with sufficient frequency In view of the drawbacks of the conventional flush toilet or urinal which can only flush water and provide a fragrant odor, without cleaning and removing the urine sediment, the inventor has, through many years of experiences in designing and making such equipment, developed the present invention, i.e., a flush toilet or urinal with an antomatic sterilizing device.

SUMMARY OF THE INVENTION

The prime object of the present invention is to provide a flush toilet or urinal with an automatic sterilizing device, which can flush and sterilize a urinal simultaneously so as to clean any urine sediment that might be left therein.

In order to fulfil the aforesaid object, the present invention has a control circuit for controlling two stages of flushing water, and a sterilizing unit which includes a sterilizing liquid container and a liquid pump to control the discharging volume of the sterilizing liquid. The liquid pump is controlled with the control circuit to pump a suitable volume of sterilizing liquid to mix with the flush water to fulfil the flushing and sterilizing functions.

DETAILED DESCRIPTION

Figure 1:
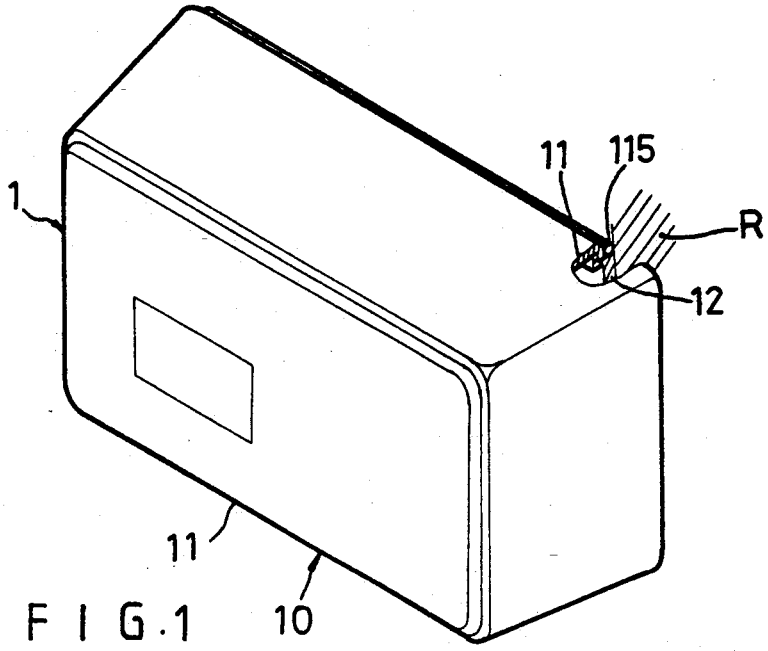
FIG. 1 is a perspective view of a flush toilet or urinal cleaning and sterilizing device according to the present invention.
Figure 3:
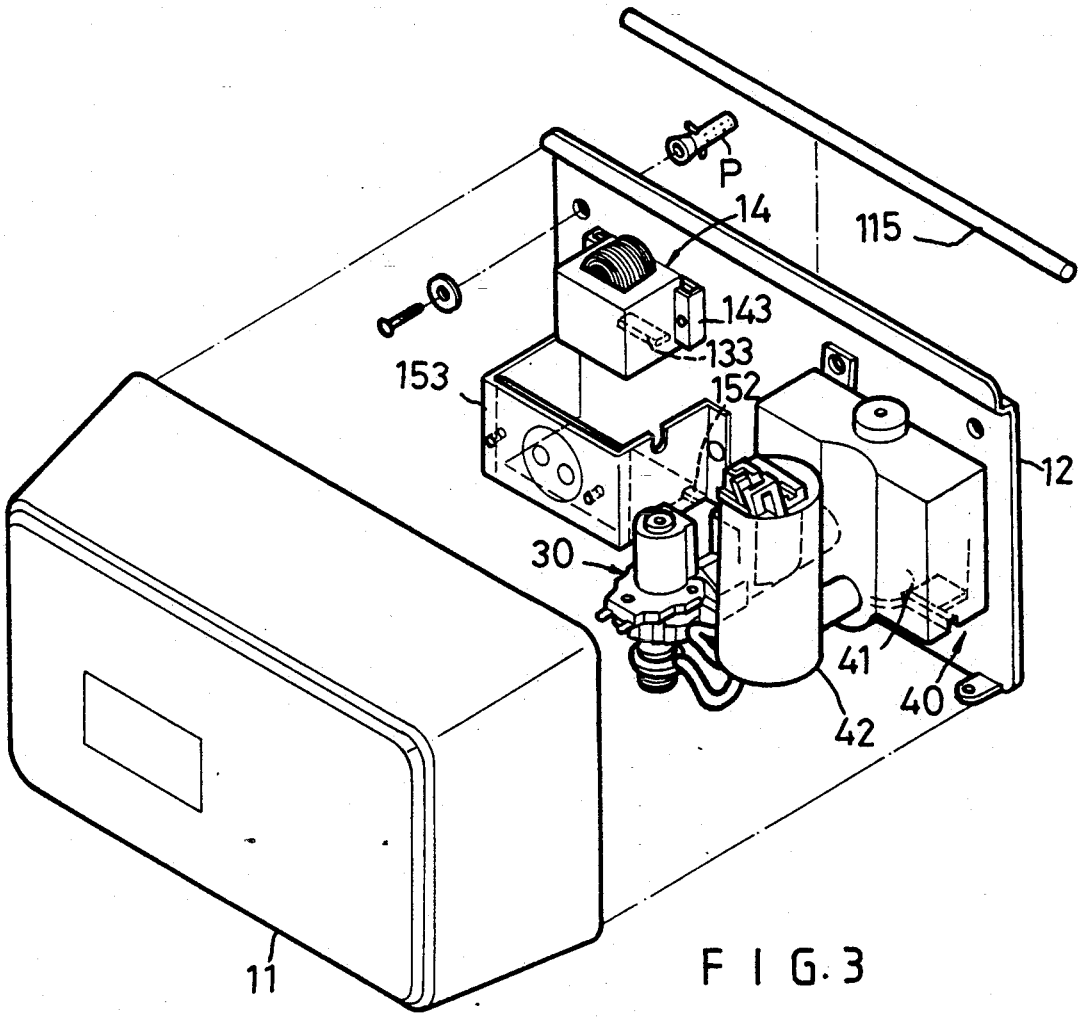
FIG. 3 is an assembled view of the present invention, showing the housing part thereof being removed.
Figure 2:
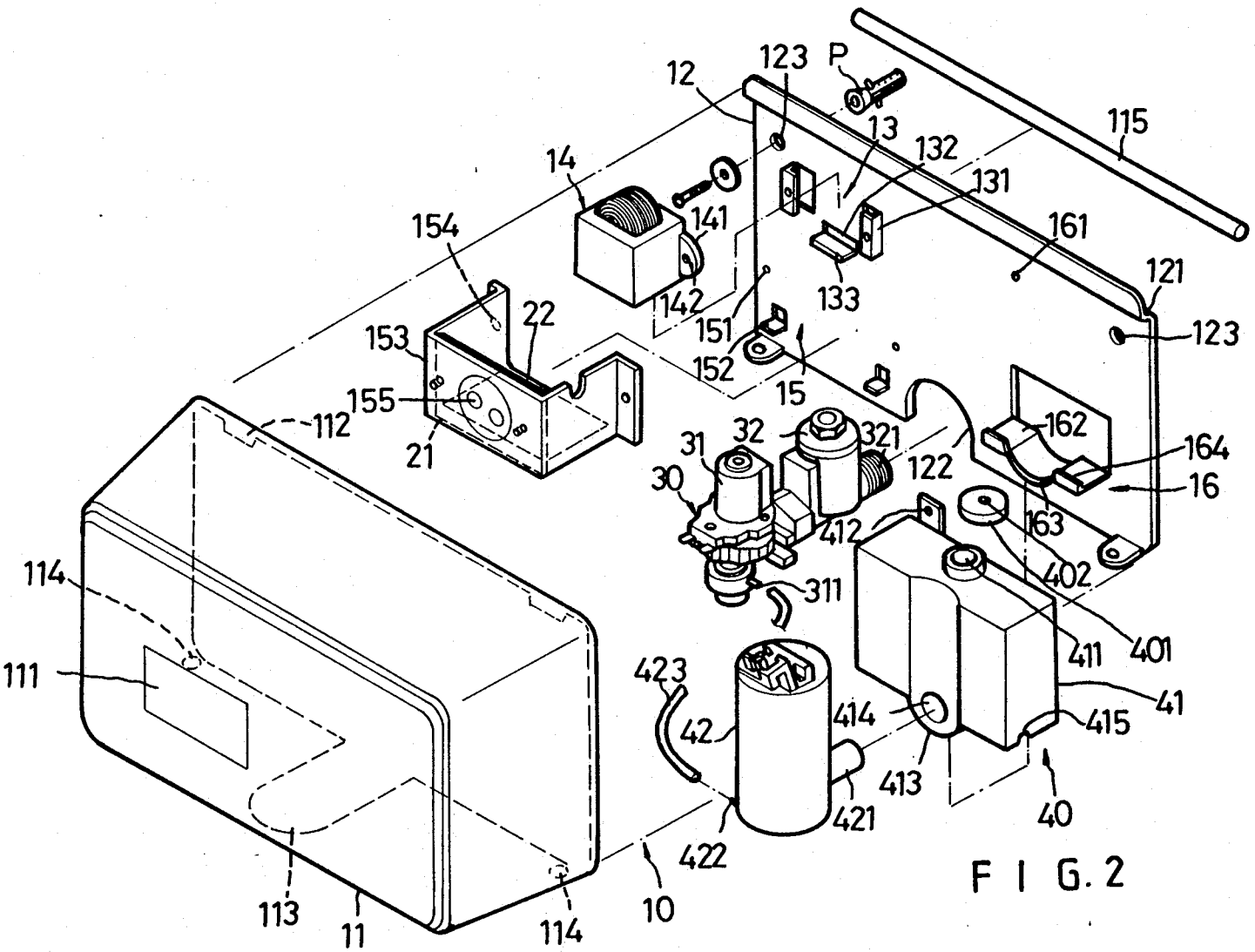
FIG. 2 is a disassembled view of the embodiment according to the present invention.

Referring to FIGS. 1, 2 and 3, the flush toilet or urinal cleaning and sterilizing device according to the present invention comprises an outer body (10), a control circuit (20), and a sterilizing unit (40). The outer body (10) includes a housing part or hood 11 and a back board (12); the housing part (11) comprises a front wall and four perimeter edge walls that fit over the edges of back board 12. The housing (hood) has a small window (111) in the front thereof, fastening tongues (112) on its rear upper edge, and, a slot (113) and two screw holes (114) on its undersurface. The top edge of the back board (12) has a flange (121) to be mated with the fastening tongues (112) so as to facilitate assembly or disassembly of the back board (12) and the housing part (11) to each other, and to facilitate inspection and replacement of various parts inside the outer housing body. Along the upper edge of back board 12, a water proof rubber strip (115) is attached and against a wall "R" to prevent liquid from infiltrating into the space circumscribed by the housing part of the outer body (10) and the back board. The slot (113) is aligned with a cut out (122) under the back board. The upper edge of the back board (12) is provided with fastening holes (123) for receiving screw bolts "P" so as to fix the back board on a wall. A transformer seat (13) includes two opposite L-shaped brackets (131) each having a through hole (132) and a fixing plate (133) for detachably mounting a transformer (14) thereon. The transformer (14) has two lugs (141) on both sides thereof, each having a through hole (142) for receiving a screw (143) which passes through the through holes (132) and (142). The lugs (141) are to be mounted in the corresponding L-shaped brackets (131) to have the transformer (14) exactly mounted on the fixing plate (133), after which the transformer can be mounted on the back board (12). A circuit board seat (15) has two fastening holes (151) and two fixing pieces (152) spaced laterally apart for mounting a U-shaped circuit bracket (153). An ear at each edge of the bracket has a fastening hole (154) aligned with one of the fastening holes (151) for receiving a screw to fasten the U-shaped circuit bracket (153) on the back board. A sterilizing unit seat (16) includes a fastening hole (161) and a fixing plate (162) which has a recess portion (163) and two hooks (164).

Figure 4A:
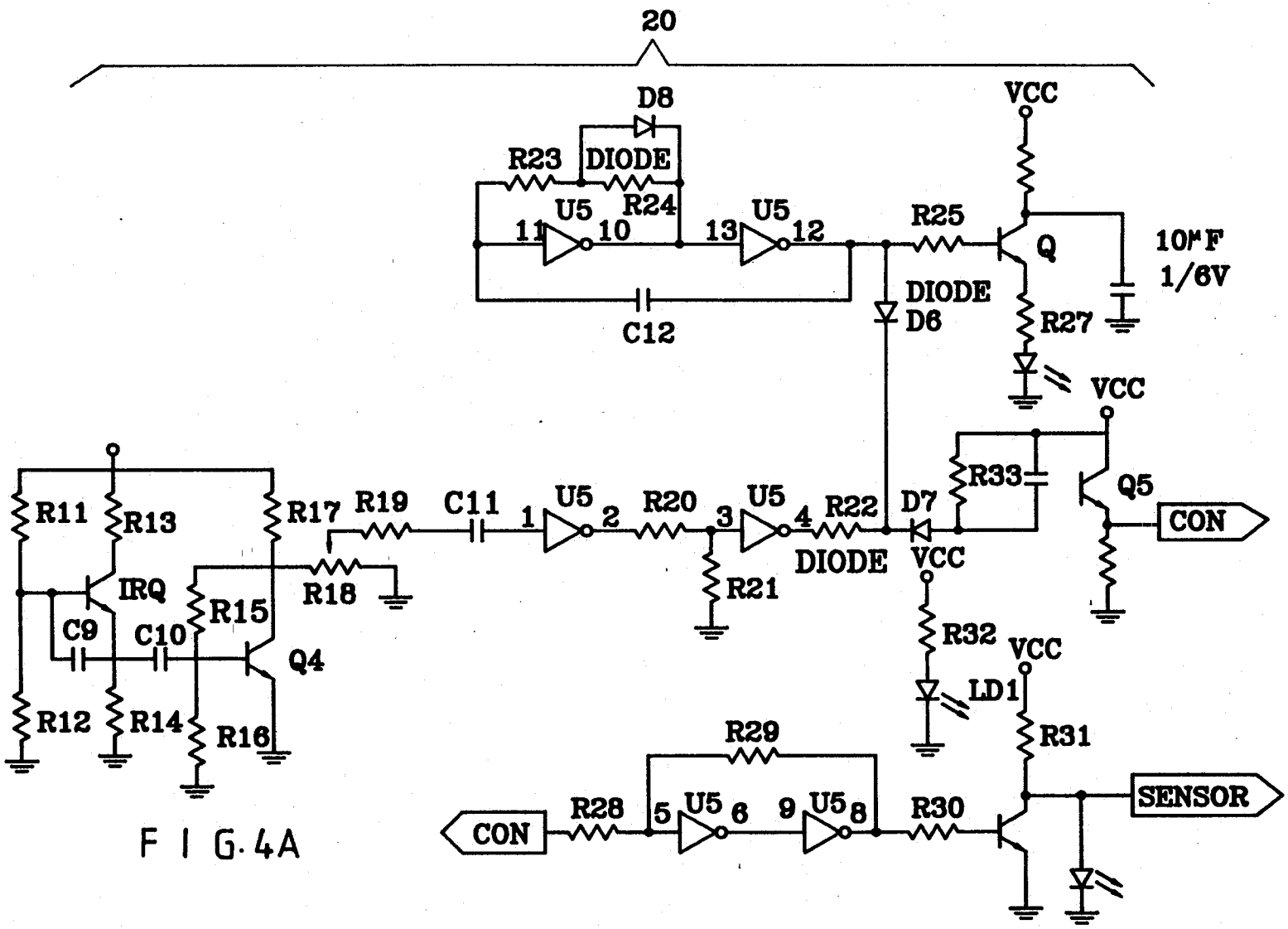
FIGS. 4A, B, and C illustrate the control circuits used in the present invention.
Figure 4B:
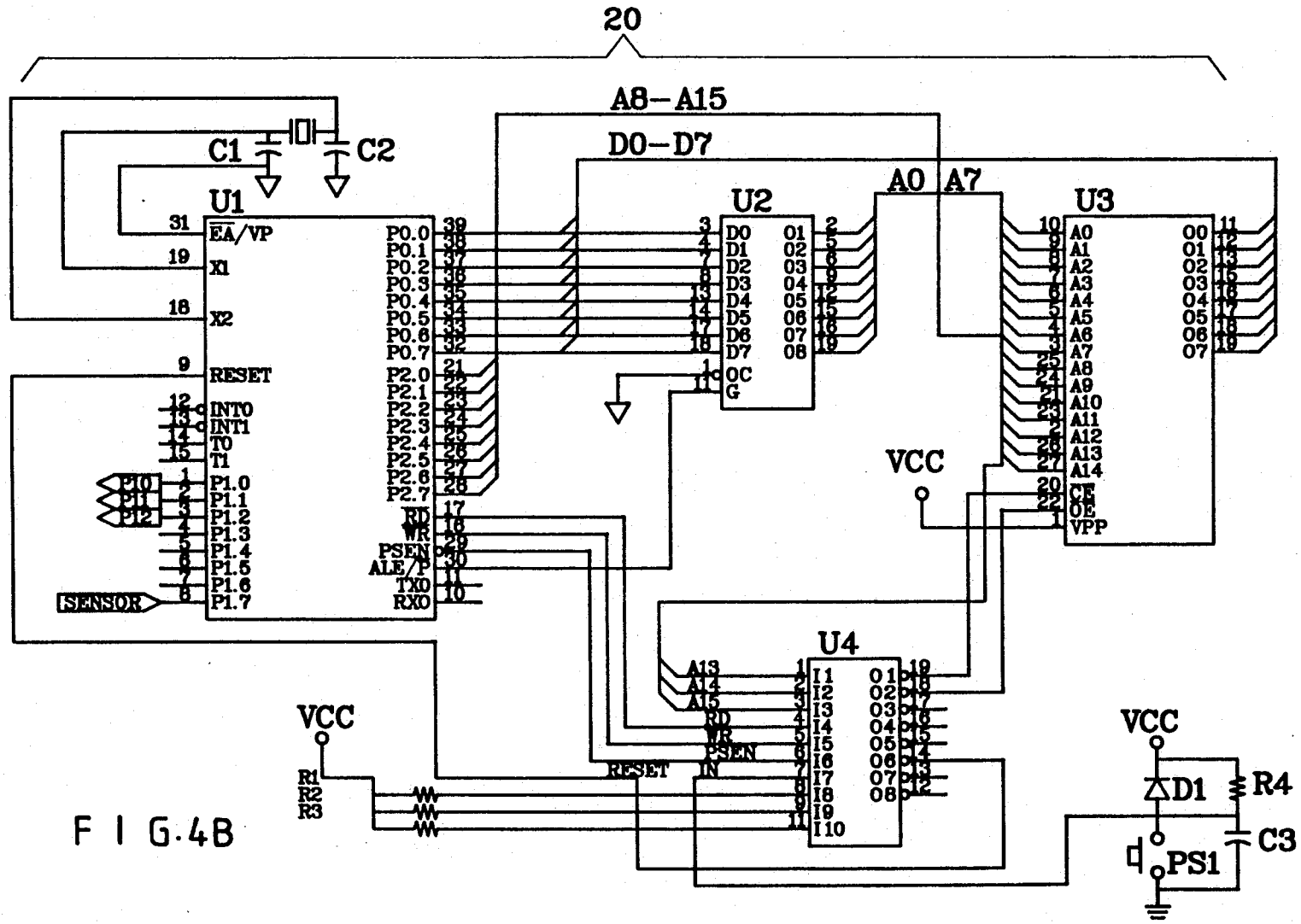
Figure 4C:
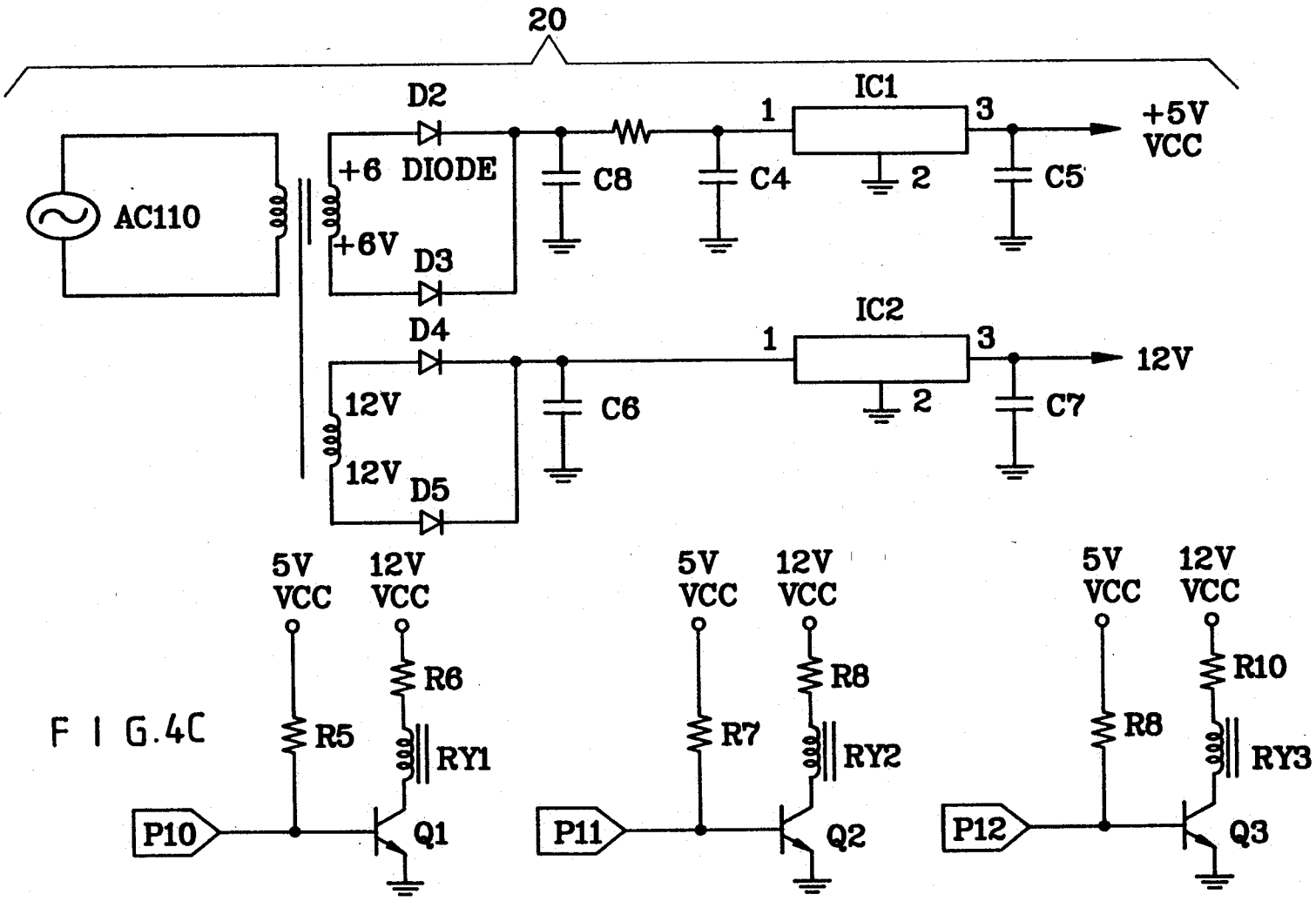
Figure 5:
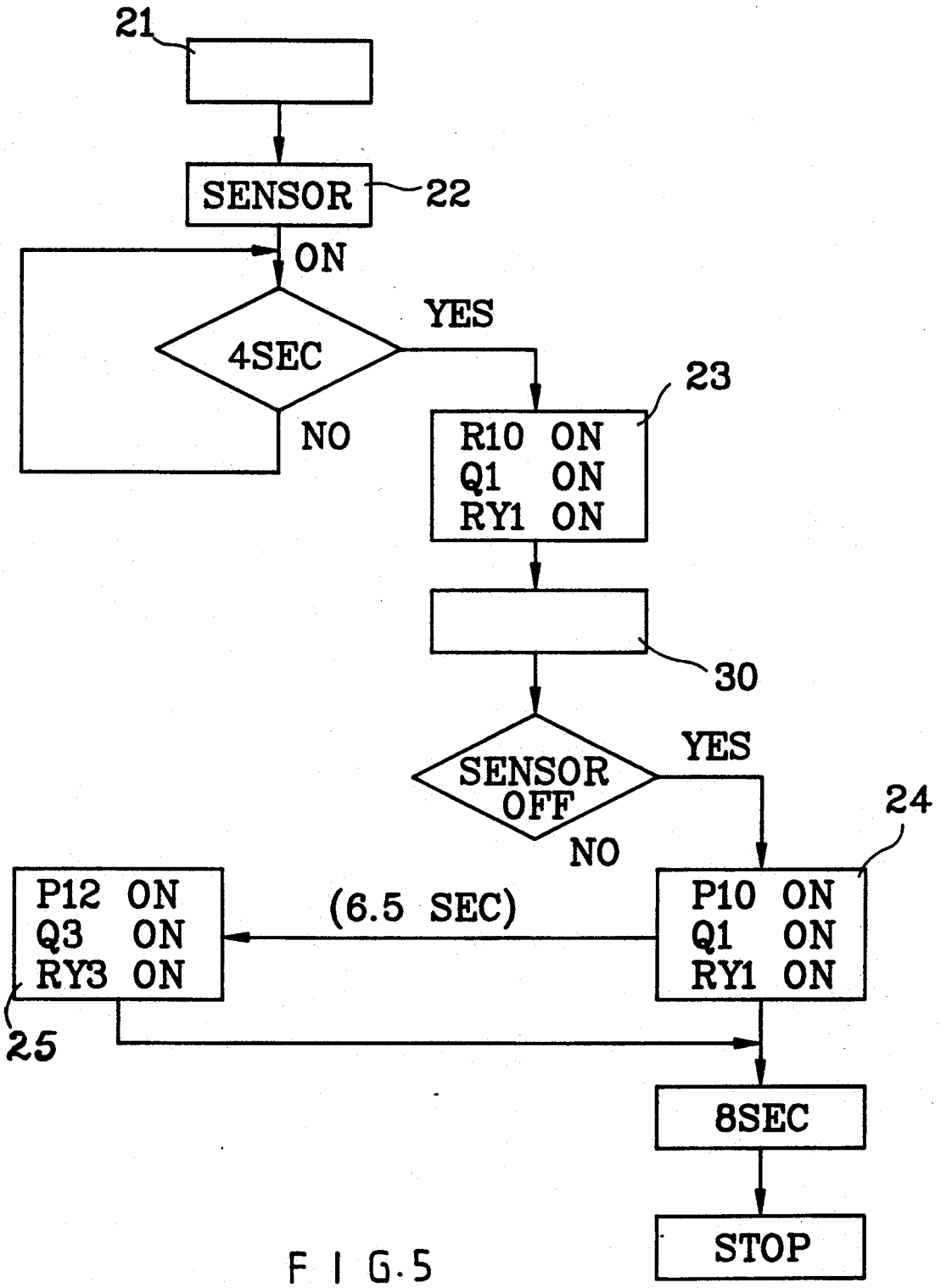
FIG. 5 is a block diagram, showing the flow chart of the control circuits used in the present invention.

As shown in FIGS. 4A, 4B and 4C, the control circuit (20) includes two PC (printed circuit) boards connected with a transformer (14). The two PC (printed circuit) boards are mounted on the U-shaped circuit bracket (153) (the circuit on the PC boards to be described later), and a sensor (155) is aligned with the small window (111) on the housing part (11).

The water supply unit (30) includes a solenoid valve (31) and a stop valve (32); the water inlet (321) of the stop valve (32) extends through a cut out (122) on the back board (12), for connection with a water pipe, not shown. The solenoid valve (31) extends directly above the slot (113) on the housing part (11), so that the valve liquid discharge outlet extends downwardly through the slot (113). One side of the water outlet has a tubular connector (311) that is adapted to telescopically connect with one end of a flow tube 423. The stop valve 32 is connected with the control circuit (20) to control the water volume through valve 31.

The sterilizing unit (40) includes a sterilizing liquid container (41) and a liquid pump (42); the liquid container (41) has a liquid inlet (411), through which the sterilizing liquid can be replenished, and a cap (401) with a vent (402). A fastening hole (161) in the sterilizing unit seat (16) is to coincide with a hole on a lug (412), which is to be fastened to the hole (161) by means of a screw. The bottom of the sterilizing liquid container (41) is to be mounted on the fixing plate (162) to have the recess portion (163) mated with a positioning lug (413) having a through hole (414) so as to have the container (41) mounted firmly on the fixing plate (162). The bottom of the container (41) has a groove (415), which is to be mated with the hooks (164) on the fixing plate (162). The liquid pump (42) has a connecting liquid inlet stub (421) to be inserted into the hole (414), whereby the pump is mounted on the front wall of the container. The liquid pump (42) has a sterilizing liquid outlet (422), that is connected to one end of a tube (423). The other end of tube 423 is connected with the connector (311) of the solenoid valve (30). The motor portion of the liquid pump (42) is electrically connected with the control circuit (20) via terminals accessible through the space above the pump, whereby the pump can be energized to generate a flow of the sterilizing liquid through tube 423.

Referring to FIGS. 4A, 4B, 4C and 5, the operation of the control circuit (20) is described as follows:

The sensor (155) can generate a signal by means of infra-red to scan a given range (a sensor circuit being shown in FIG. 4A); then, the micro-CPU (22) would judge whether there is a user within a given range. When the sensor has sensed a user standing in front of a urinal for four seconds, the sensor will send a signal (23) to the micro-CPU (22) (as shown in FIGS. 4B and 4C, the signal will be transmitted from P10 to transistor Q1 to have the relay switch Ry1 turned on) to have the solenoid valve (30) opened so as to provide a first flush for at least three seconds. As soon as the user leaves the urinal, the sensor has no signal sensed, but it will send a signal (24) to the micro-CPU (of which the circuit is shown in FIG. 4C; a signal will be sent, through P10, to the transistor Q1 to have the solenoid switch Ry1 turned on) 5 to have a solenoid valve opened to provide a second flush for at least eight seconds.

During the second flush period at the stage of about 6.5 seconds, the micro-CPU will generate a signal (25) (as shown in FIG. 4C, the signal will be sent from P12 to transistor Q3 to have a relay switch Ry3 turned on) to control the liquid pump (42) to run so as to pump a given volume of sterilizing liquid to flow through a tube (423) to the solenoid valve (30), where the sterilizing liquid and the flushing water will be mixed together before being discharged (the supplying time of the sterilizing liquid is about 0.5 second, while the flushing water is continuing, so as to let the sterilizing liquid have sufficient time to wash away the uring sediment until the end of eight seconds). Consequently, two functions, i.e., the water flushing and urine sediment washing can be done simultaneously and effectively.

The major feature of the present invention is that the sterilizing liquid container is controlled with the liquid pump for discharging a suitable volume of sterilizing liquid, and the control circuit can control the solenoid valve and the liquid pump to operate integrally. In real use, two functions of water flushing and urine sediment washing can be done simultaneously so as to improve the drawbacks of a conventional flush toilet or urinal relating to inadequate removal of urine sediment, and an undesired generation of odors.

In brief, the present invention can meet the object of the invention, and can eliminate the drawback of a conventional urinal that is often the subject of customer complaints.

It is understood that the attached drawings are used merely for describing an embodiment of the invention, and the modifications or changes can be made while still practicing the present invention.

I claim:

1. A urinal cleaning and sterilizing device comprising a vertical back board (12) having an upper edge, a lower edge and two side edges;

a step down transformer (14) detachably mounted on said back board near one of the side edges;

an electronic circuit means mounted on said back board in vertical alignment with said transformer;

a sterilizing liquid container means (41) mounted on said back board near its other side edge; said container means having a front wall, and a liquid discharge opening in said front wall;

a motor-operated pump mounted on the front wall of said container means; said pump having a liquid inlet (421) connected to the liquid discharge opening, said pump having a liquid outlet (422); said pump comprising a motor having terminals accessible through the space above the pump;

an upright solenoid valve means (30, 32) centrally located between said sterilizing liquid container means and said electronic circuit means; said solenoid valve means having a water supply inlet means (321) extending through the backboard near its lower edge; said solenoid valve means having a downwardly-directed liquid discharge means;

a connector tube (311) extending from the pump outlet to said liquid discharge means so that when both the solenoid valve means and the pump are electrically energized a dilute sterilizing solution flows downwardly through said liquid discharge means;

said transformer and said electronic circuit means being electrically connected to said solenoid valve means and said pump, such that the valve means can be operated alone, and then the valve means and pump can be operated synchronously to achieve a cleaning and sterilizing cycle; and and a hood (10) detachably connected to said backboard in surrounding relation to the transformer, circuit means, container means, pump and solenoid valve means;

said hood having a front wall extending generally parallel to said backboard; said electronic circuit means comprising an integral infrared sensor (155) targeted through the hood front wall to trigger the circuit means;

said circuit means being constructed so that the valve means and pump are operated synchronously only when said sensor signals the circuit means that a person is no longer standing in front of the urinal, whereby the sterilizing operation constitutes the final phase in each cycle.

* * * * *